US011564441B2

(12) United States Patent
Patt et al.

(10) Patent No.: US 11,564,441 B2
(45) Date of Patent: Jan. 31, 2023

(54) SHOE WITH MULTILAYER UPPER

(71) Applicant: Cole Haan LLC, New York, NY (US)

(72) Inventors: Scott Patt, Greenland, NH (US); James Jackman Chan, Jersey City, NJ (US); Jeffrey Mokos, Greenland, NH (US)

(73) Assignee: COLE HAAN LLC, Greenland, NH (US)

( * ) Notice: Subject to any disclaimer, the term of this patent is extended or adjusted under 35 U.S.C. 154(b) by 69 days.

(21) Appl. No.: 16/283,504

(22) Filed: Feb. 22, 2019

(65) Prior Publication Data

US 2020/0268097 A1 Aug. 27, 2020

(51) Int. Cl.

| | |
|---|---|
| ***A43B 9/14*** | (2006.01) |
| ***A43B 13/12*** | (2006.01) |
| ***A43B 23/02*** | (2006.01) |
| ***A43B 9/00*** | (2006.01) |
| ***A43B 1/00*** | (2006.01) |
| ***A43B 3/10*** | (2006.01) |
| ***A43B 23/22*** | (2006.01) |
| *A43B 3/00* | (2022.01) |

(52) U.S. Cl.

CPC ..... *A43B 9/00* (2013.01); *A43B 1/0018* (2013.01); *A43B 3/107* (2013.01); *A43B 3/108* (2013.01); *A43B 9/14* (2013.01); *A43B 13/122* (2013.01); *A43B 23/0205* (2013.01); *A43B 23/0295* (2013.01); *A43B 23/222* (2013.01); *A43B 3/0036* (2013.01); *A43B 23/025* (2013.01); *A43B 23/0255* (2013.01)

(58) Field of Classification Search

CPC ..... A43B 3/06; A43B 9/14; A43B 13/122; A43B 13/16; A43B 23/0295; A43B 23/087; A43B 13/386; A43B 13/40

See application file for complete search history.

(56) References Cited

U.S. PATENT DOCUMENTS

| | | | | | |
|---|---|---|---|---|---|
| 1,861,844 | A * | 6/1932 | Dodge | A43B 3/101 | 36/18 |
| 1,941,853 | A * | 1/1934 | Colavito | A43B 3/101 | 36/68 |
| 1,988,281 | A * | 1/1935 | Maccarone | A43B 13/16 | 12/146 BP |
| 2,228,149 | A * | 1/1941 | Maccarone | A43B 13/41 | 36/24.5 |
| 2,398,623 | A * | 4/1946 | Daniels | A43B 7/085 | 12/146 R |
| 2,563,100 | A * | 8/1951 | Chandler | A43B 9/14 | 12/142 F |
| 4,658,516 | A * | 4/1987 | Beck | A43B 13/16 | 12/142 RS |
| 6,092,307 | A * | 7/2000 | Singer | A43B 9/00 | 36/12 |

(Continued)

*Primary Examiner* — Sharon M Prange

(74) *Attorney, Agent, or Firm* — Thompson Coburn LLP

(57) ABSTRACT

A shoe including a sole and an upper. The upper is coupled to the sole. The upper includes an outer layer and an inner layer. The outer layer has an outer surface and an inner surface. The inner surface of the outer layer is in direct contact with the inner layer. The outer layer is a hot melt thermoplastic material, and the inner layer is a material different from that of the outer layer. At least a portion of the outer layer is adhered to the inner layer, and the inner layer including a portion not covered by the outer layer.

8 Claims, 10 Drawing Sheets

(56) References Cited

U.S. PATENT DOCUMENTS

| | | | | |
|---|---|---|---|---|
| 6,670,029 | B2 | 12/2003 | Norton et al. | |
| 8,347,438 | B2 * | 1/2013 | Bell | A43B 23/0235 12/146 C |
| 8,429,835 | B2 * | 4/2013 | Dojan | A43B 5/00 36/3 A |
| 2011/0088285 | A1 | 4/2011 | Dojan et al. | |
| 2016/0345678 | A1 | 12/2016 | Mokos | |
| 2017/0150777 | A1 | 6/2017 | Youngs et al. | |
| 2017/0202303 | A1 | 7/2017 | Shepherd et al. | |
| 2017/0280816 | A1 | 10/2017 | Lyden | |
| 2019/0208858 | A1 | 7/2019 | Mokos et al. | |
| 2019/0208859 | A1 | 7/2019 | Mokos et al. | |

* cited by examiner

SHOE WITH MULTILAYER UPPER

CROSS-REFERENCE TO RELATED APPLICATIONS

Not Applicable.

STATEMENT REGARDING FEDERALLY SPONSORED RESEARCH OR DEVELOPMENT

Not Applicable.

APPENDIX

An appendix accompanies this specification and is a part thereof. The appendix depicts additional images of embodiments disclosed herein.

BACKGROUND

Field

This disclosure pertains to a shoe upper.

SUMMARY

One aspect of the disclosure pertains to a shoe including a sole and an upper. The sole includes a sole heel end, a sole toe end, a sole heel region, a sole midfoot region, a sole metatarsal region, a sole ball region, and a sole toe region. The sole heel region extends longitudinally from the sole heel end toward the sole midfoot region, the sole midfoot region extends longitudinally from the sole heel region toward the sole metatarsal region, the sole metatarsal region extends longitudinally from the sole midfoot toward the sole ball region, the sole ball region extends longitudinally from the midfoot toward the sole toe region, and the sole toe region extends longitudinally from the sole midfoot region to the sole toe end. The upper is coupled to the sole. The upper includes an upper heel end, an upper toe end, an upper heel region, an upper midfoot region, an upper metatarsal region, an upper ball region, an upper toe region, a rand region, a throat region, a throat opening, a collar region, a lateral side, and a medial side. The upper heel region extends longitudinally from the upper heel end toward the upper midfoot region, the upper midfoot region extends longitudinally from the upper heel region toward the upper metatarsal region, the upper metatarsal region extends longitudinally from the upper metatarsal region toward the upper ball region, the upper ball region extends longitudinally from the upper metatarsal region toward the upper toe region, the upper toe region extends longitudinally from the upper ball region to the upper toe end, and the rand region extends upward from a junction of the sole and the upper. The throat opening forms an opening adapted and configured to receive a foot. The collar region extends downward from and around the throat opening. The throat region extends longitudinally from the throat opening toward the upper toe end. The upper includes an outer layer and an inner layer. The outer layer has an outer surface and an inner surface. The inner surface of the outer layer is in direct contact with the inner layer. The outer layer is a hot melt thermoplastic material, and the inner layer is a material different from that of the outer layer. At least a portion of the outer layer is adhered to the inner layer, and the inner layer including a portion not covered by the outer layer.

Further features and advantages of the present disclosure, as well as the operation of the embodiments described herein, are described in detail below with reference to the accompanying drawings.

Figure 1:
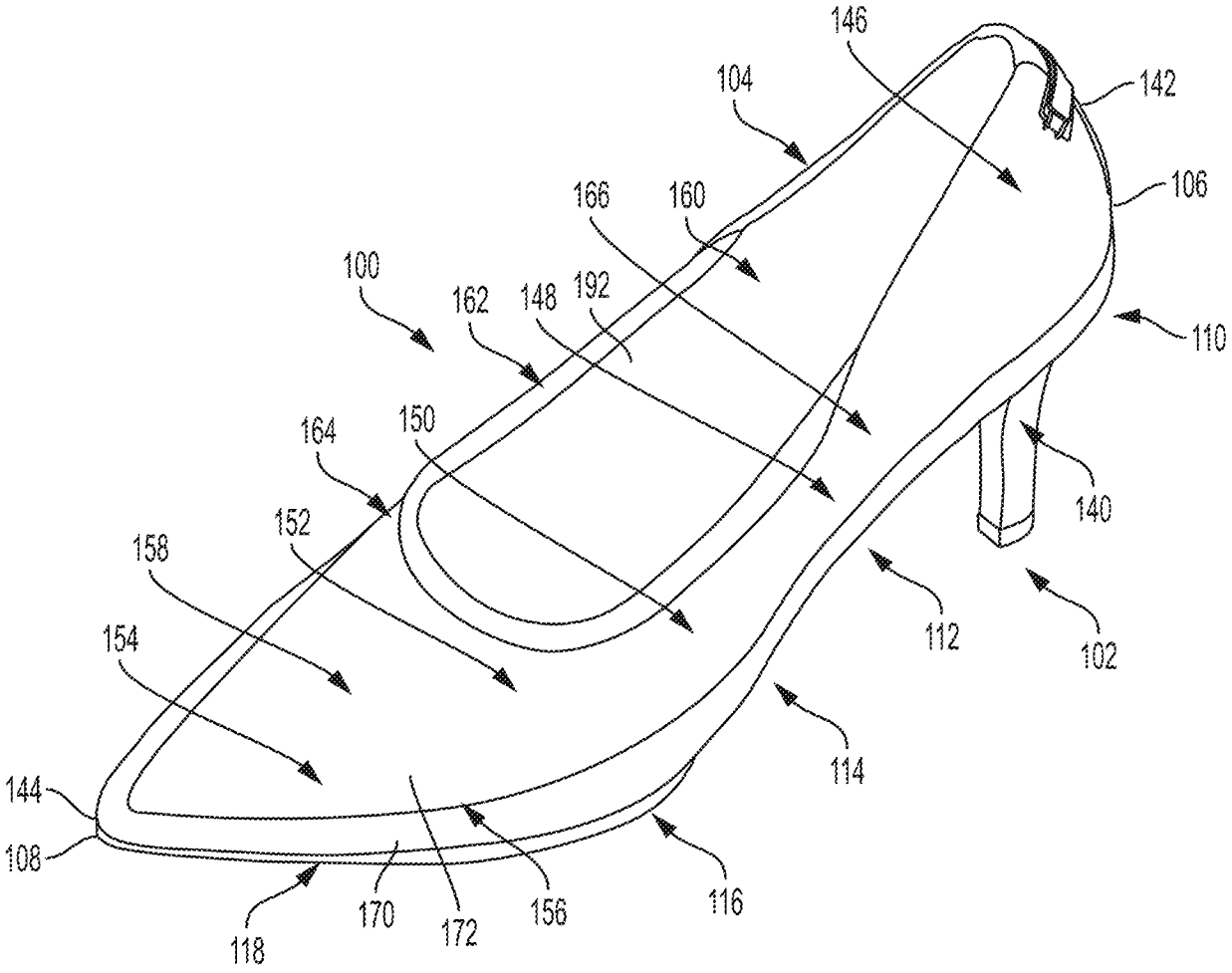
FIG. 1 is a perspective view of an exemplary embodiment of a shoe of the present disclosure.

Appendix Figures A1-A74 depict an alternative embodiment similar to that shown in FIG. 1. Appendix Figures A75-A148 depict additional views of the embodiment shown in FIG. 7. Appendix Figures A149-A222 depict additional views of the embodiment shown in FIG. 9. Appendix Figures A223-A296 depict additional views of the embodiment shown in FIG. 11.

Reference numerals in the written specification and in the drawing figures indicate corresponding items.

DETAILED DESCRIPTION

An embodiment of a shoe in accordance with the present disclosure is indicated by reference numeral 100 in FIGS. 1-6. The shoe 100 includes a sole 102 and an upper 104. The upper 104 is operatively coupled to the sole 102 using any suitable technique or material such as adhesive, stitching, or the like. The sole 102 includes a sole heel end 106, a sole toe end 108, a sole heel region 110, a sole midfoot region 112, a sole metatarsal region 114, a sole ball region 116, and a sole toe region 118. The sole heel region 110 extends longitudinally from the sole heel end 106 toward the sole midfoot region 112. The sole midfoot region 112 extends longitudinally from the sole heel region 110 toward the sole metatarsal region 114. The sole metatarsal region 114 extends longitudinally from the sole midfoot region 112 toward the sole ball region 116. The sole ball region 116 extends longitudinally from the sole metatarsal region 114 toward the sole toe region 118. The sole toe region 118 extends longitudinally from the sole ball region 116 to the sole toe end 108.

The sole 102 includes an insole board member 120 and a cushion member 122, the insole board member has a top surface 124 and a bottom surface 126. The cushion member 122 has a top surface 128 and a bottom surface 130. The insole board member has a forefoot opening 132. The forefoot opening 132 extends within one or more of the sole toe region 118, sole ball region 116, or sole metatarsal region 114. In the embodiment depicted, the forefoot opening 132 extends within each of the sole toe region 118, sole ball region 116, and the sole metatarsal region 114. The cushion member 122 extends within the forefoot opening 132 such that the top surface 128 of the cushion member 122 is flush with the top surface 124 of the insole board member 120. The cushion member 122 extends downward and outward such that the cushion member 122 overlies the bottom surface 126 of the insole board member 120 in the sole toe region 118, the sole ball region 116, and the sole metatarsal region 114.

The cushion member 122 includes a traction pattern 134 molded into the bottom surface 130 of the cushion member 122. Advantageously, this allows a one-piece cushion member 122 to function both as a cushion member and as the outsole of the shoe 100. This eliminates the need for a separate outsole piece. The opening 132 in the insole board member 120 accommodates the upper portion of the cushion member 122 while the lower portion wraps around the bottom of the insole board to provide a larger ground contact patch than the opening in the insole board. The cushion member 122 is coupled to the insole board 120 using any suitable technique and/or material such as adhesive, stitching, or the like. The insole board member is thermoplastic polyurethane, and the cushion member is compression molded ethylene-vinyl acetate foam. In alternative embodiments, other suitable materials may be used for the cushion member such as thermoplastic polyurethane foam, rubber, plastic, or the like. In alternative embodiments, other suitable materials may be used for the insole board member such as plastic, leather, metal, or the like.

In some embodiments, the insole board member 120 includes more than one component and/or material. For example, the insole board member 120 may include a stiffer portion 136 and a more flexible cushion portion 138. The stiffer portion 136 may function as a shank or otherwise provide rigidity to the shoe 100. The stiffer portion 136 may be made of a suitable material such as thermoplastic polyurethane, metal, plastic, leather, or the like. The cushion portion 138 overlies the stiffer portion 136 and may contribute to the rigidity of the shoe 100 and/or provide cushioning. The cushion portion 138 may be made of a suitable material such as compression molded ethylene-vinyl acetate foam, other foam, plastic, rubber, leather, or the like. The cushion portion 138 may be present only in one or more of the sole heel region 110, sole midfoot region 112, or sole metatarsal region 114. The cushion portion 138 is not present in the sole toe region 118.

In some embodiments, the sole 102 includes a heel member 140. The heel member 140 is coupled to the insole board 120 in the sole heel region 110. For example, the heel member 140 may be coupled to the insole board 120 using nails, screws, adhesives, and/or the like. The heel member 140 may be a stiletto type heel, wedge type heel, or other heel.

The upper 104 coupled to the sole 102 includes an upper heel end 142, an upper toe end 144, an upper heel region 146, an upper midfoot region 148, an upper metatarsal region 150, an upper ball region 152, an upper toe region 154, a rand region 156, a throat region 158, a throat opening 160, a collar region 162, a lateral side 164, and a medial side 166.

The upper heel region 146 extends longitudinally from the upper heel end 142 toward the upper midfoot region 148. The upper midfoot region 148 extends longitudinally from the upper heel region 146 toward the upper metatarsal region 150. The upper metatarsal region 150 extending longitudinally from the upper midfoot region 148 toward the upper ball region 152. The upper ball region 152 extends longitudinally from the upper metatarsal region 150 toward the upper toe region 154. The upper toe region 154 extends longitudinally from the upper ball region 152 to the upper toe end 144. The rand region 156 extends upward from a junction 168 of the sole 102 and the upper 104. The throat opening 160 forms an opening adapted and configured to receive a foot. The collar region 162 extends downward from and around the throat opening 160. The throat region 158 extends longitudinally from the throat opening 160 toward the upper toe end 144.

The upper 104 includes an outer layer 170 and an inner layer 172. The outer layer 170 has an outer surface and an inner surface. The inner surface of the outer layer 170 is in direct contact with the inner layer 172. The outer layer 170 overlies a portion of the inner layer 172. The outer layer 170 is a hot melt thermoplastic material. For example, and without limitation, the hot melt material may be an ethylene-vinyl acetate base with a terpene-phenol resin tackifier. In alternative embodiments, the base material may be any suitable material such as polyethylene, polyester, polybutene, polyolefin, or the line. Alternative tackifiers may be rosins, terpenes, or the like. Additional additives may include waxes, plasticizers, ultraviolet stabilizers, pigments, or the like.

The inner layer 172 is a material different from that of the outer layer 170. For example, the inner layer 172 is neoprene (e.g., neoprene foam). In alternative embodiments, the inner layer 172 is one or more of neoprene, leather, faux leather, knitted fabric, or non-knitted fabric. In still further alternative embodiments, the outer layer 170 is hot melt and couples an additional layer (e.g., a leather layer) to the inner layer 172. The additional layer is coextensive with the outer layer 170.

At least a portion of the outer layer 170 is adhered to the inner layer such that the inner layer 172 includes a portion not covered by the outer layer 170. In other words, the inner layer 172 (e.g., of neoprene) is visible and the outer layer 170 of hot melt material is attached over a portion of the inner layer. The outer layer 170 is not adhered to the inner layer 172 using a discrete adhesive separate from the outer layer itself. Rather, the hot melt material composition of the outer layer 170 allows the outer layer to adhere directly to the inner layer. In some embodiments, the outer layer 170 is adhered to only a portion of the inner layer. The inner layer may be at least partially free from the outer layer such that at least a portion of the inner layer is capable of moving independently of the outer layer. In alternative embodiments, the entirety of the outer layer 170 is adhered to the inner layer 172. In some embodiments, the outer layer 170 may also be stitched to the inner layer 172.

The collar region 162 may include a collar formed by stitching the inner layer 172. In some embodiments, additional stitching may be added to the inner layer 172 for decorative or structural effect. Additionally, the shoe 100 may include an interior liner or bootie 192. The liner 192 may be made of a knit fabric, leather, or other suitable material. The liner 192 may be stitched to the inner layer 172. The liner 192 may be coextensive with the inner layer 172. Alternatively, the liner 192 may overlie only a portion of the inner surface of the inner layer 172.

Figure 2:
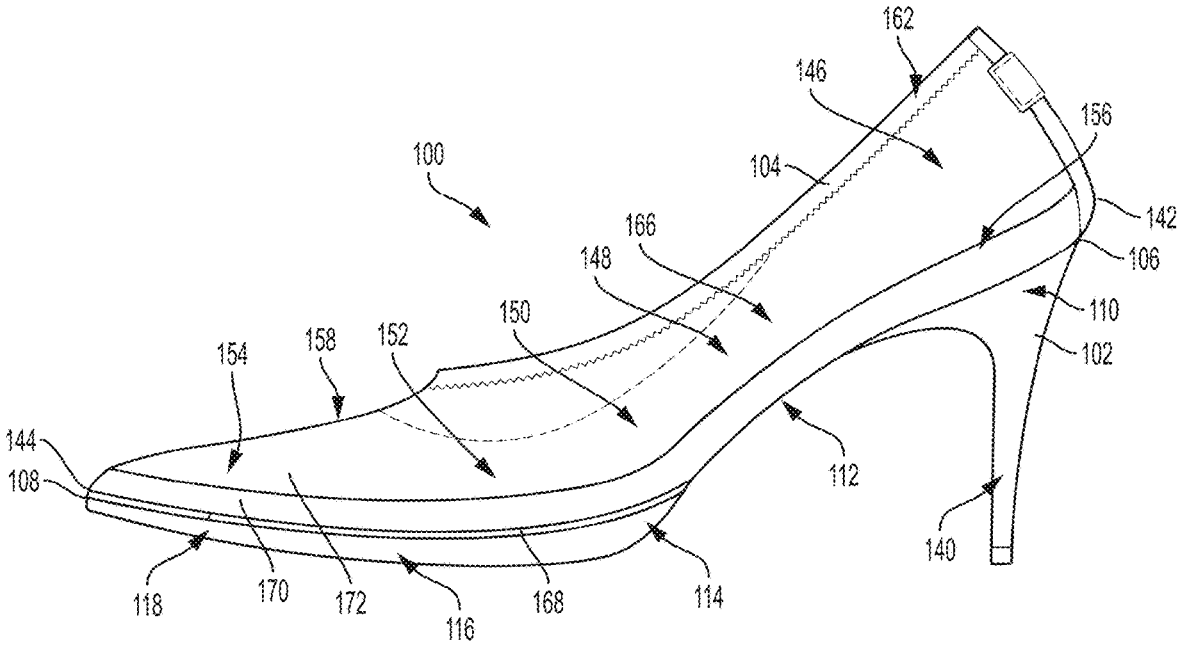
FIG. 2 is a medial side view of the shoe shown in FIG. 1.
Figure 3:
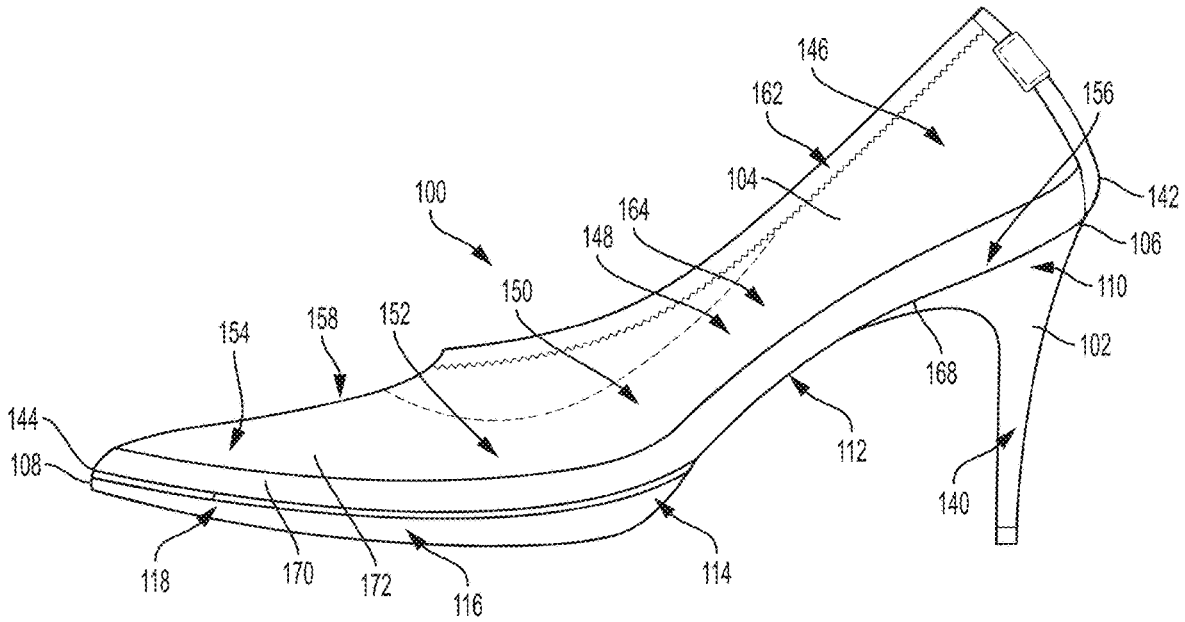
FIG. 3 is a lateral side view of the shoe shown in FIG. 1.
Figure 4:
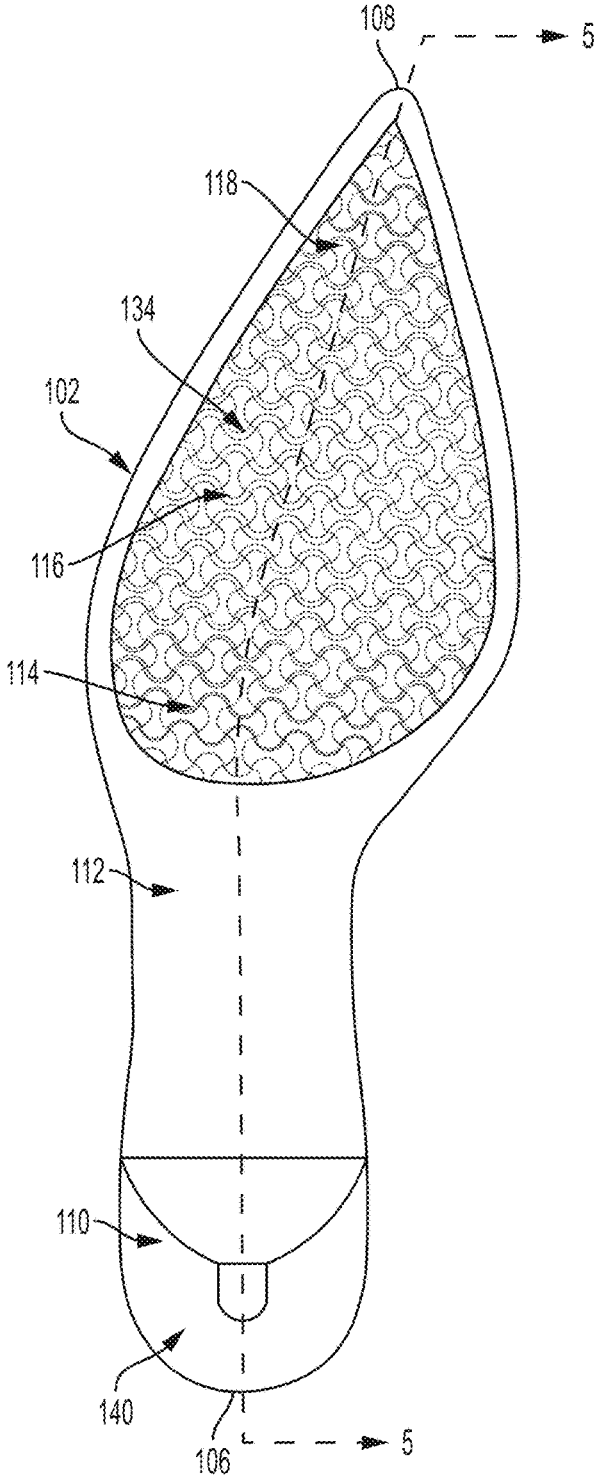
FIG. 4 is a bottom view of the sole of the shoe shown in FIG. 1.
Figure 5:
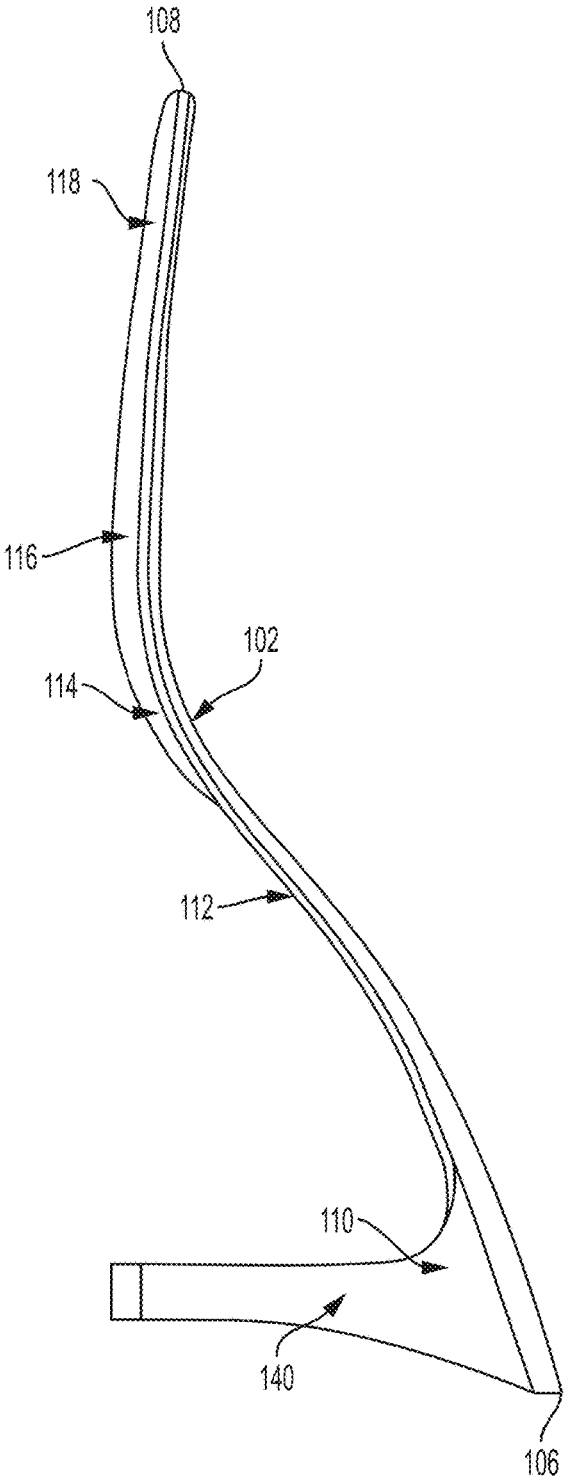
FIG. 5 is a medial side view of the sole of the shoe shown in FIG. 1.
Figure 6:
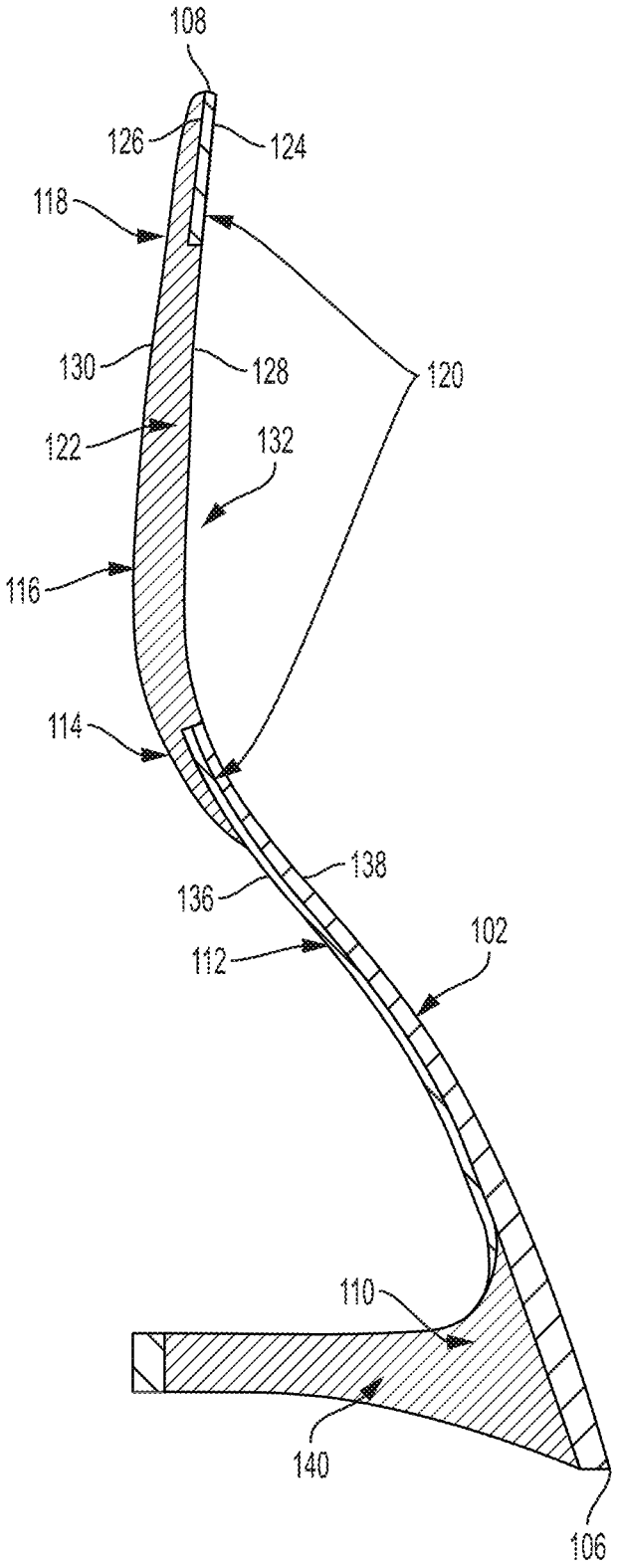
FIG. 6 is a cross-sectional view taken among the plane of line 5-5 of FIG. 4.

In one embodiment, as depicted in FIGS. 1-3, the outer layer 170 is present only within the rand region 156. The rand region 156 extends upward between 0.25 inches and 1 inches from the junction 168 of the sole 102 and the upper 104. More preferably, the rand region extends upward between 0.4 and 0.6 inches, and more preferably extends upward for 0.5 inches.

FIGS. 7-12 depict alternative embodiments of a shoe according to the present disclosure. In referring to these alternative embodiments, like part numbers refer to like parts with similar or the same structure and/or function. For example, part number 170 refers to the outer layer as does part number 270 (e.g., with both outer layers being a hot melt material but differing in the coverage of the inner layer 172).

Figure 7:
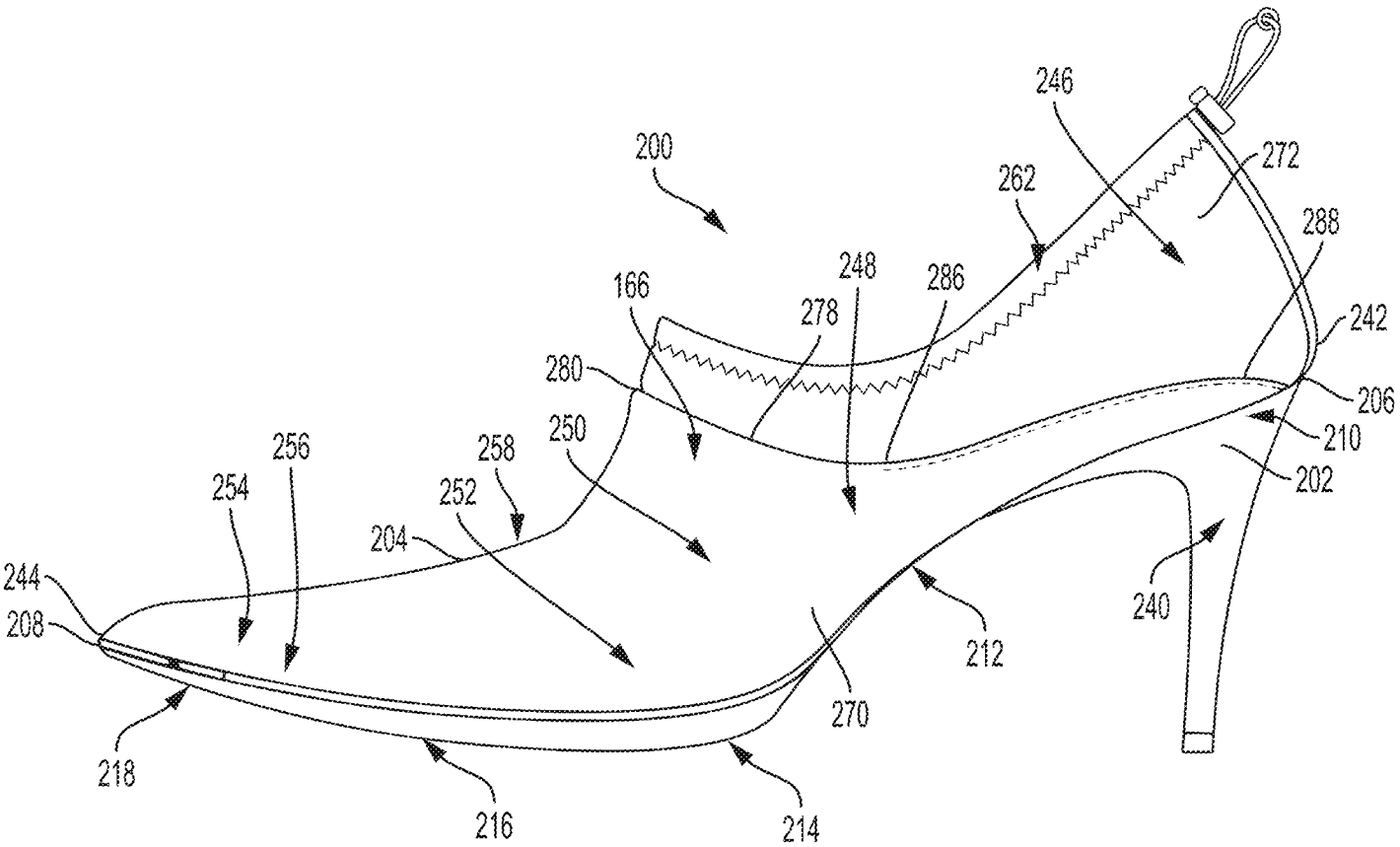
FIG. 7 is a medial side view of an exemplary embodiment of a shoe of the present disclosure.
Figure 8:
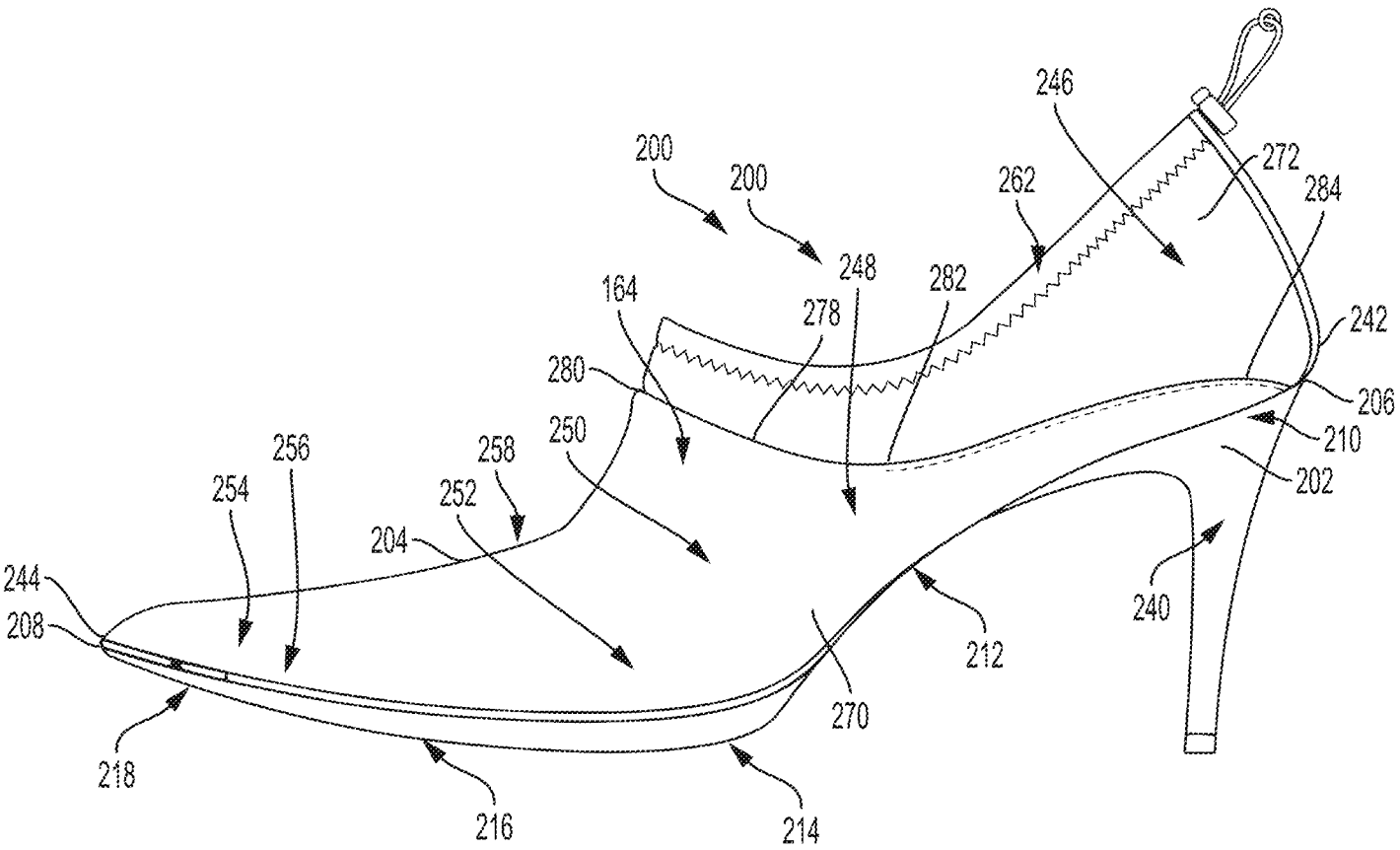
FIG. 8 is a lateral side view of the shoe shown in FIG. 7.

Referring to FIGS. 7-8, an additional embodiment of a shoe 200 according to the present disclosure is depicted. The shoe 200 is substantially similar to the shoe 100 but includes differences as described in the following. The outer layer 270 is present within the upper toe region 254, the upper ball region 252, the upper metatarsal region 250, and the throat region 258. The outer layer 270 is not present within the collar region 262. The outer layer 270 is present within the entirety of the upper toe region 254, the entirety of the upper ball region 252, and the entirety of the throat region 258 outside the collar region 262. The outer layer 270 is present within the upper midfoot region 248 and the upper heel region 246.

The portion of the outer layer 270 within the upper metatarsal region 250, upper midfoot region 248, and upper heel region 246 extends upward from the junction 268 between the upper and the sole to a sinusoidal upper edge 278. The sinusoidal upper edge 278 has a first apex 280 in the throat region, a second apex 282 in the upper midfoot region of the lateral side, a third apex 284 in the upper heel region on the lateral side, a fourth apex 286 in the upper midfoot region on the medial side, and a fifth apex 288 in the upper heel region on the medial side. The outer layer 270 is not present within a portion of the upper heel region 246 extending transversely about the upper heel end 142 and upward from the junction 268 of the sole and the upper to the throat opening 260.

Figure 9:
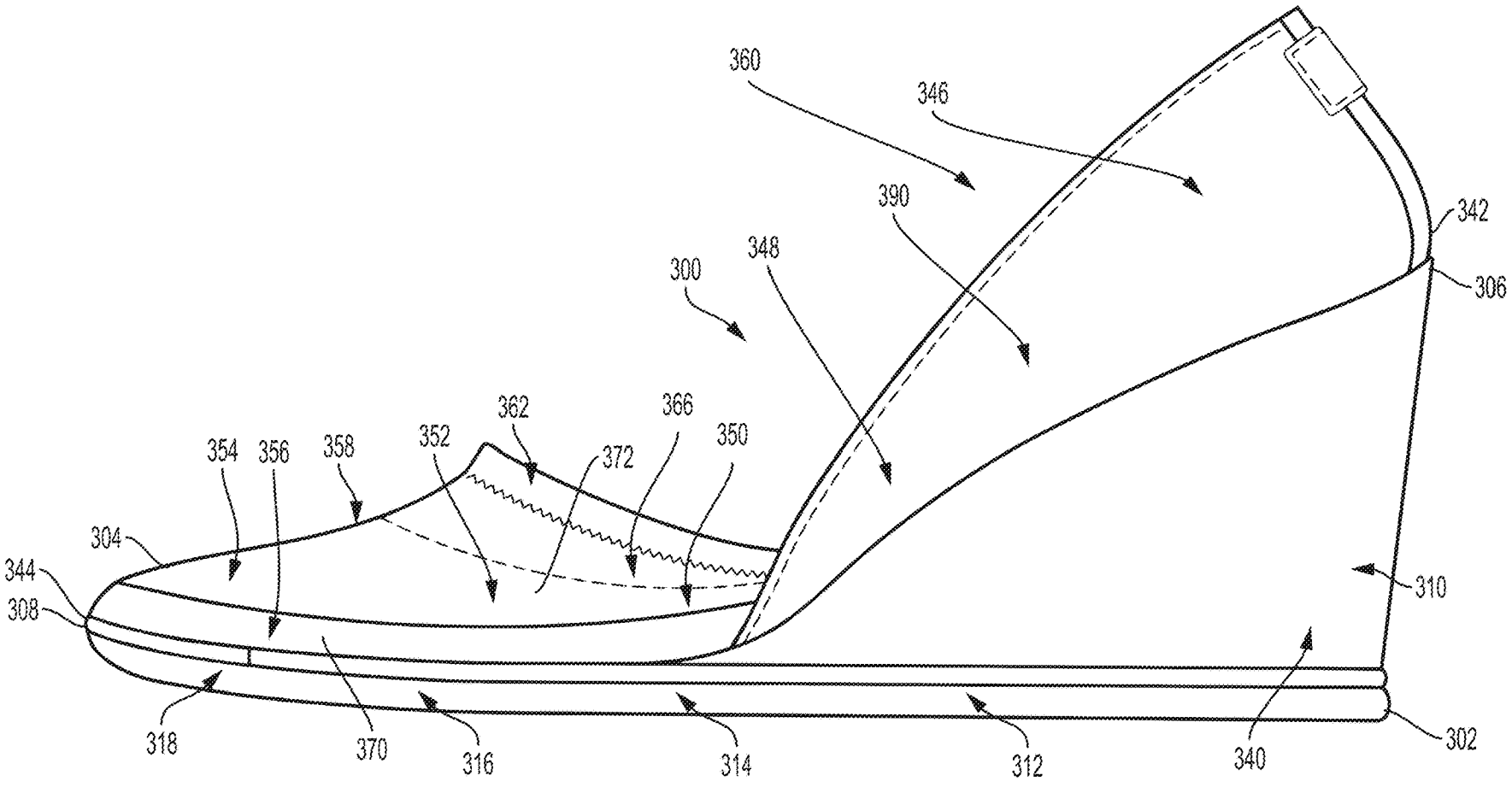
FIG. 9 is a medial side view of an exemplary embodiment of a shoe of the present disclosure.
Figure 10:
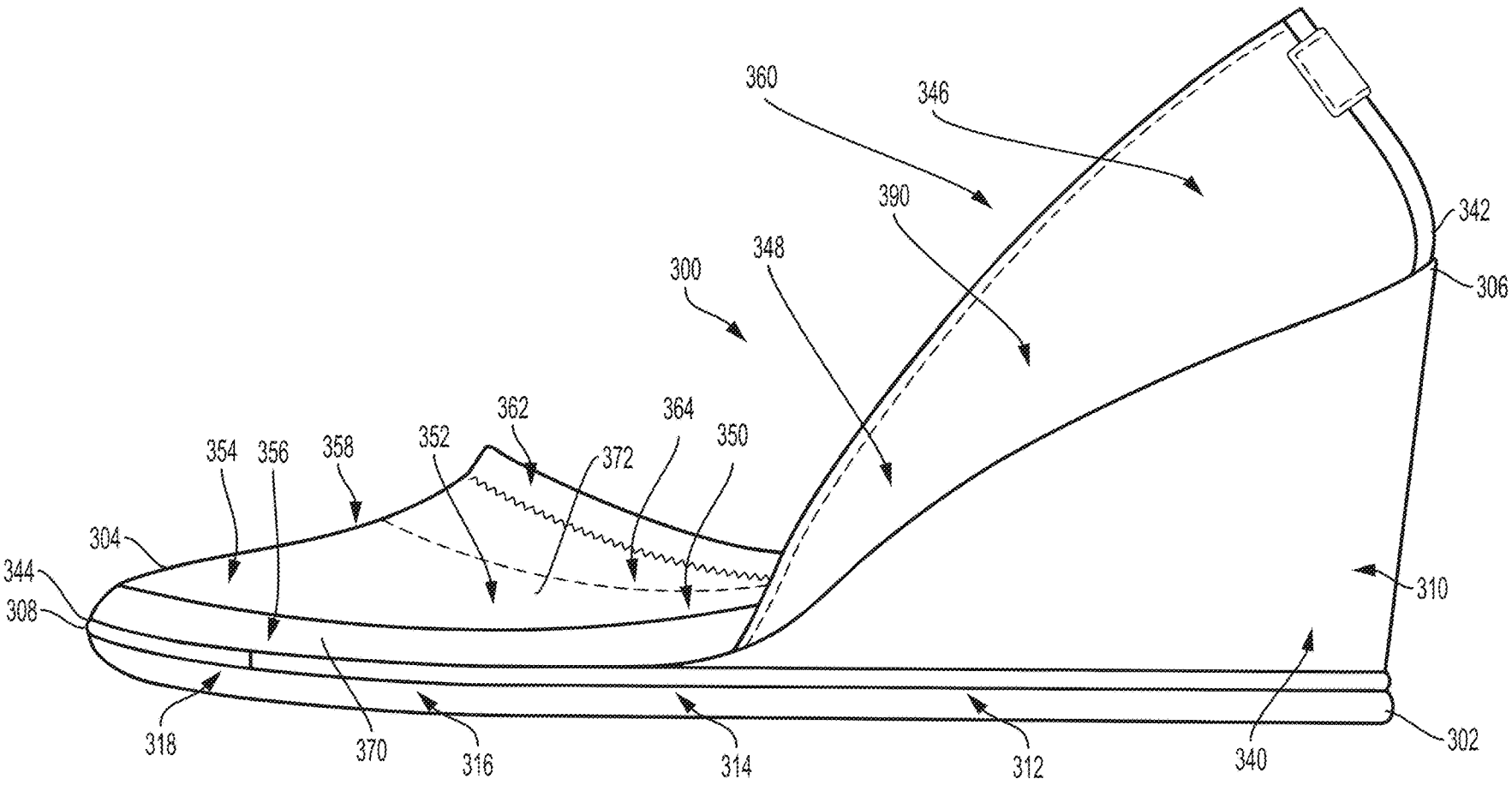
FIG. 10 is a lateral side view of the shoe shown in FIG. 9.

Referring to FIGS. 9-10, an additional embodiment of a shoe 300 according to the present disclosure is depicted. The shoe 300 is substantially similar to the shoe 100 but includes differences as described in the following. The shoe 300 includes a chassis member 390 coupled to the sole 302 and coupled to the upper 304. The chassis member 390 at least partially overlaps the outer layer 370 in the upper metatarsal region 350. The outer layer 370 is present only within the rand region 356. The chassis member 390 forms a portion of the upper 304 within the upper metatarsal region 350, the upper midfoot region 348, and upper heel region 346. The chassis member 390 forms a portion of the throat region 358 and the throat opening 360. The inner layer 372 forms a portion of the upper 304 within the upper toe region 354, the upper ball region 352, and the upper metatarsal region 350.

Figure 11:
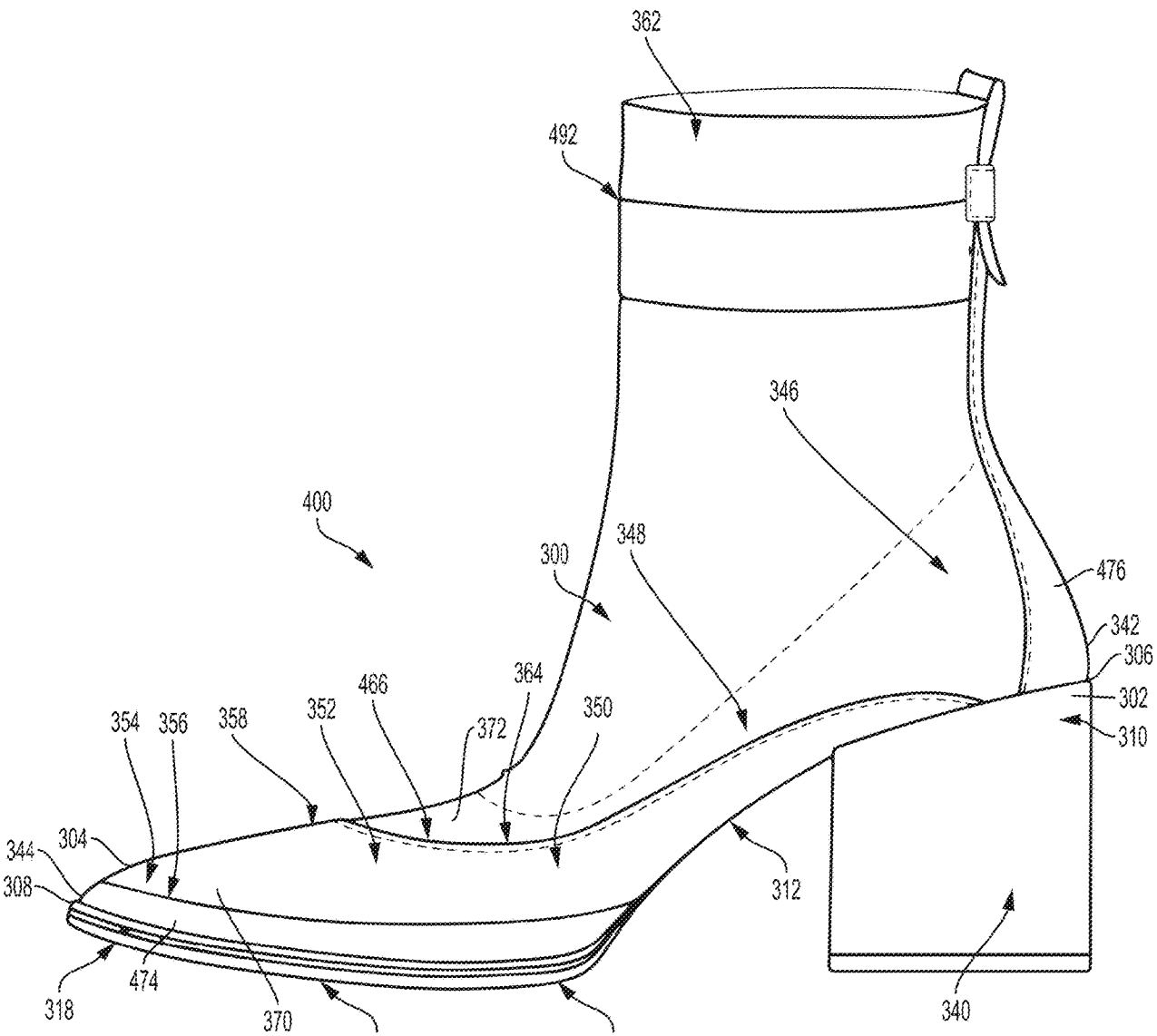
FIG. 11 is a medial side view of an exemplary embodiment of a shoe of the present disclosure.
Figure 12:
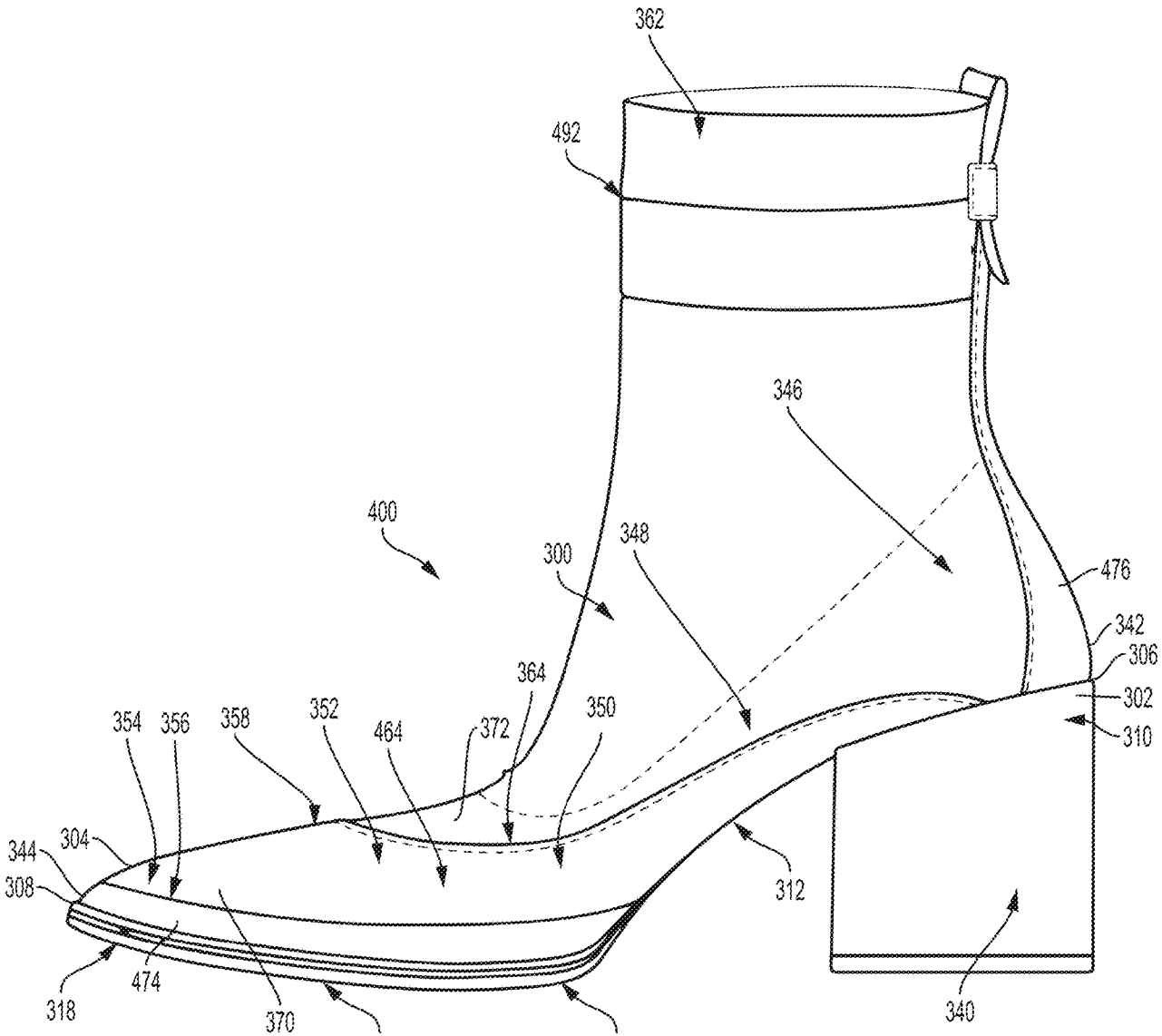
FIG. 12 is a lateral side view of the shoe shown in FIG. 11.

Referring to FIGS. 11-12, an additional embodiment of a shoe 400 according to the present disclosure is depicted. The shoe 400 is substantially similar to the shoe 100 but includes differences as described in the following. The outer layer 470 is present within the rand region 456 and extends outside of the rand region 456. The outer layer 456 extends into at least the upper toe region 454 and the throat region 458. The outer layer 456 may also extend within the upper ball region 452, upper metatarsal region 450, upper midfoot region 448, and upper heel region 446. The shoe 400 further includes a rand 474 coupled to the outer layer 470 in the rand region 456. The rand 474 is only present in the upper toe region 454, upper ball region 452, and upper metatarsal region 450. The rand 474 is one or more of leather, faux leather, hot melt thermoplastic material, or plastic. The shoe 400 further includes a heel counter 476. The heel counter overlies only the inner layer 472. The heel counter 476 may be leather, plastic, or other suitable material. The heel counter 476 may be stitched to the inner layer 472. The outer layer 470 may also be stitched to the inner layer 472. The shoe 400 further includes an elastic webbing cuff 492 in the collar region 462.

Appendix Figures A1-A74 depict an alternative embodiment similar to that shown in FIG. 1. Appendix Figures A75-A148 depict additional views of the embodiment shown in FIG. 7. Appendix Figures A149-A222 depict additional views of the embodiment shown in FIG. 9. Appendix Figures A223-A296 depict additional views of the embodiment shown in FIG. 11.

In view of the foregoing, it should be appreciated that the shoe of the disclosure has several advantages over the prior art.

As various modifications could be made in the constructions and methods herein described and illustrated without departing from the scope of the disclosure, it is intended that all matter contained in the foregoing description or shown in the accompanying drawings shall be interpreted as illustrative rather than limiting. For example, the wedge shoe may be any type of wedge shoe, such as a wedge sandal, a wedge pump, an open-toe wedge, a platform wedge, etc. Thus, the breadth and scope of the present disclosure should not be limited by any of the above-described exemplary embodiments, but should be defined only in accordance with the following claims appended hereto and their equivalents.

It should also be understood that when introducing elements in the present disclosure in the claims or in the above description of exemplary embodiments of the disclosure, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations.

What is claimed is:

1. A shoe comprising:

a sole comprising a sole heel end, a sole toe end, a sole heel region, a sole midfoot region, a sole metatarsal region, a sole ball region, and a sole toe region, the sole heel region extending longitudinally from the sole heel end toward the sole midfoot region, the sole midfoot region extending longitudinally from the sole heel region toward the sole metatarsal region, the sole metatarsal region extending longitudinally from the sole midfoot region toward the sole ball region, the sole ball region extending longitudinally from the sole midfoot region toward the sole toe region, the sole toe region extending longitudinally from the sole ball region to the sole toe end;

an upper coupled to the sole, the upper comprising an upper heel end, an upper toe end, an upper heel region, an upper midfoot region, an upper metatarsal region, an upper ball region, an upper toe region, a rand region, a throat region, a throat opening, a collar region, a lateral side, and a medial side, the upper heel region extending longitudinally from the upper heel end toward the upper midfoot region, the upper midfoot region extending longitudinally from the upper heel region toward the upper metatarsal region, the upper metatarsal region extending longitudinally from the upper midfoot region toward the upper ball region, the upper ball region extending longitudinally from the upper metatarsal region toward the upper toe region, the upper toe region extending longitudinally from the upper ball region to the upper toe end, the rand region extending upward from a junction of the sole and the upper, the throat opening forming an opening adapted and configured to receive a foot, the collar region extending downward from and around the throat opening, the throat region extending longitudinally from the throat opening toward the upper toe end;

the upper comprising an outer layer and an inner layer, the outer layer extending adjacent the sole continuously from the upper toe region to at least the upper ball region, the outer layer having an outer surface and an inner surface, the inner surface of the outer layer being in direct contact with the inner layer, the outer layer comprising a hot melt thermoplastic material, the inner layer comprising a material different from that of the outer layer, at least a portion of the outer layer being adhered to the inner layer, the inner layer including an exposed portion, the exposed portion being not covered by the outer layer and not covered by any component of the shoe, the exposed portion being at least in the collar region immediately adjacent the throat opening; and a chassis member coupled to the sole and coupled to the upper, wherein the chassis member at least partially overlaps the outer layer in the upper metatarsal region, wherein the chassis member forms a portion of the upper within the upper metatarsal region, upper mid-foot region, and upper heel region, wherein the chassis member forms a portion of the throat region and the throat opening, and wherein the inner layer forms a portion of the upper within the upper toe region, the upper ball region, and the upper metatarsal region.

2. A shoe in accordance with claim 1, the inner layer comprising neoprene.

3. A shoe in accordance with claim 1, wherein the outer layer is not adhered to the inner layer using a discrete adhesive separate from the outer layer itself.

4. A shoe in accordance with claim 1 wherein the outer layer is adhered to only a portion of the inner layer.

5. A shoe in accordance with claim 1 wherein the entirety of the outer layer is adhered to the inner layer.

6. A shoe in accordance with claim 1 wherein the outer layer is present only within the rand region.

7. A shoe in accordance with claim 1 the sole comprising an insole board member and a cushion member, the insole board member having a top surface and a bottom surface, the cushion member having a top surface and a bottom surface, the insole board member having a forefoot opening, the forefoot opening extending within one or more of the sole toe region, sole ball region, or sole metatarsal region, the cushion member extending within the forefoot opening such that the top surface of the cushion member is flush with the top surface of the insole board member, the cushion member extending downward and outward such that the cushion member overlies the bottom surface of the insole board member in the sole toe region, the sole ball region, and the sole metatarsal region.

8. A shoe in accordance with claim 7, wherein the cushion member comprises a traction pattern molded into the bottom surface of the cushion member, the insole board member comprises thermoplastic polyurethane, and the cushion member comprises compression molded ethylene-vinyl acetate foam.

* * * * *